US007546998B2

(12) United States Patent
Chen

(10) Patent No.: US 7,546,998 B2
(45) Date of Patent: Jun. 16, 2009

(54) FAN FIXING STRUCTURE

(75) Inventor: Wen-Haw Chen, Hsinchu (TW)

(73) Assignee: Inventec Corporation, Taipei (TW)

( * ) Notice: Subject to any disclaimer, the term of this patent is extended or adjusted under 35 U.S.C. 154(b) by 1 day.

(21) Appl. No.: 11/643,658

(22) Filed: Dec. 22, 2006

(65) Prior Publication Data

US 2008/0149807 A1 Jun. 26, 2008

(51) Int. Cl.
*F16M 3/00* (2006.01)

(52) U.S. Cl. ..... 248/674

(58) Field of Classification Search ..... 248/674, 248/675, 680, 681, 544, 222.52, 222.51, 248/223.41, 224.8, 222.41, 225.11, 500, 248/154, 671

See application file for complete search history.

(56) References Cited

U.S. PATENT DOCUMENTS 4,514,105 A * 4/1985 Adams et al. ..... 403/24
5,295,653 A * 3/1994 Miyazaki et al. ..... 248/675
6,179,446 B1 * 1/2001 Sarmadi ..... 362/264

FOREIGN PATENT DOCUMENTS

TW 200525338 1/1993
TW M285896 1/2006

* cited by examiner

*Primary Examiner*—Ramon O Ramirez
(74) *Attorney, Agent, or Firm*—Muncy, Geissler, Olds & Lowe, PLLC

(57) ABSTRACT

A fan fixing structure for holding a fan and fixing it on a housing is provided. The structure includes a guide piece secured on the housing, a cover plate, a resilient piece and a positioning element. The cover plate is pivoted on the guide piece and pivotedly rotates between an open position and a closed position. When the cover plate is in the open position, it further shifts to an engaged position. Therefore, the fan is moved into the guide piece by the guidance of the guide piece, and then fixed on the housing by pivotedly rotating the cover plate to the closed position and moving it to the engaged position. Meanwhile, the fan is stably located in the engaged position by the proper arrangement of the resilient piece and the positioning element. The object of easily assembling, fixing and disassembling the fan without tools is achieved.

5 Claims, 5 Drawing Sheets

FAN FIXING STRUCTURE

BACKGROUND OF THE INVENTION

1. Field of Invention

The present invention relates to a fan fixing mechanism, and more particularly to a fixing mechanism which fixes a fan to a housing of an electronic device with a clip-snap mechanism.

2. Related Art

It is very common in the art to dispose a fan in an electronic equipment so as to perform heat dissipation for the electronic equipment. And respective manufacturers have respective skills in how to fix the fan to the electronic equipment, for example, a housing, in a proper and convenient way. For example, a fan fixing device and an electronic equipment thereof disclosed in Taiwan Patent Publication No. 200525338 include a substrate and a fastener. The substrate is provided with a fixing portion, and one end of the fastener is connected with the fixing portion to fix the fan on the substrate.

Furthermore, a fan fixing device disclosed in Utility Model No. M285896 published on 11 Jan. 2006 is used to fix the fan in a base of the electronic equipment. The device includes a mounting bracket fixed to the base and a fixing piece for fixing the fan to the mounting bracket. The mounting bracket includes two side plates, and a clipping hole is respectively opened on one end of the two side plates. The fixing piece includes two fixing portions with resilience, and each fixing portion has a clipping block protruded corresponding to the clipping hole of corresponding side plate of the mounting bracket. The two fixing portions are respectively provided with an operating portion. Therefore, this fan fixing device enables a user to assemble and disassemble the fan without the need of a tool, thus enhancing the convenience.

It will be appreciated from the above-mentioned patents that there are various practices in conventional art for fixing a fan, and some of them require for screw and securing tools or adding additional mechanisms to the fan frame, such that much inconvenience in both assembling and disassembling is caused. Accordingly, some manufactures have also proposed a fixing device which achieves the fixing and assembling of a fan without tools, but they still employ the practice of adding a part like clipping blade spring on the fan frame. In this way, when a fan failure occurs, it is still necessary to remove the additional part on the fan, which results in much inconvenience.

In addition, after the fan is fixed, noise is generated due to the vibration accompanying the rotation of rotor. Therefore, the fan fixing device will develop towards how to effectively fix the fan for easy assembling and disassembling with a vibration-absorbing effect after fixing the fan.

SUMMARY OF THE INVENTION

In view of the above, the present invention is directed to providing a fan fixing structure to solve the problems in conventional fan fixing devices such as the need for tools to secure the fan, noise generated during operation after fixing the fan, and adding means to the fan, so as to enable a user to mount, fix and disassemble the fan on the housing of an electronic device without using tools. The fan fixing structure can absorb vibration during operation, reduce the noise, and meanwhile reduce the total number of parts without adding any additional means on the fan, such that it is unnecessary to demount the means from the fan for recovery and use during maintenance.

The fan fixing structure of the present invention is used to hold the fan and fix it on the housing. The structure comprises a guide piece and a cover plate. The cover plate is pivoted on a rotating column of the guide piece by a guide slot, such that the cover plate may pivotedly rotate between an open position and a closed position. When the cover plate is located in the closed position, it shifts to an engaged position. Thus, when the cover plate is located in the open position, the fan can enter the guide piece by the guidance of the guide piece. Moreover, the fan is fixed on the housing by pivotedly rotating the cover plate to the closed position and moving it to the engaged position.

Besides, the fan fixing structure of the present invention further comprises a resilient piece to place the fan within the guide piece. In normal state, the resilient piece pushes the fan towards the cover plate to make the securing state more stable and achieve a vibration-absorbing effect.

Furthermore, the fan fixing structure of the present invention further comprises a positioning element for keeping the cover plate in the engaged position, so as to avoid the cover plate from pivotedly rotating to the open position in operational state.

Accordingly, with the design of the present invention, a user can place the fan into the fan fixing structure through the guide piece, then pivotedly rotate the cover plate to the closed position and move the cover plate to the engaged position, thus fixing the fan on the housing due to the actions of the resilient piece and the positioning element. On the contrary, when disassembling the fan, it only needs to move the cover plate to the closed position and pivotedly rotate it to the open position in sequence, and the resilient piece will automatically eject the fan, thus achieving the object of fixing and disassembling the fan without any tool or adding any means to the fan. Meanwhile, the structure also has the efficacy of absorbing vibration and reducing noise due to the pushing of the resilient piece.

The features and practices with regard to the present invention will now be illustrated as detailed below in the most preferable embodiments in accompanying with the drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
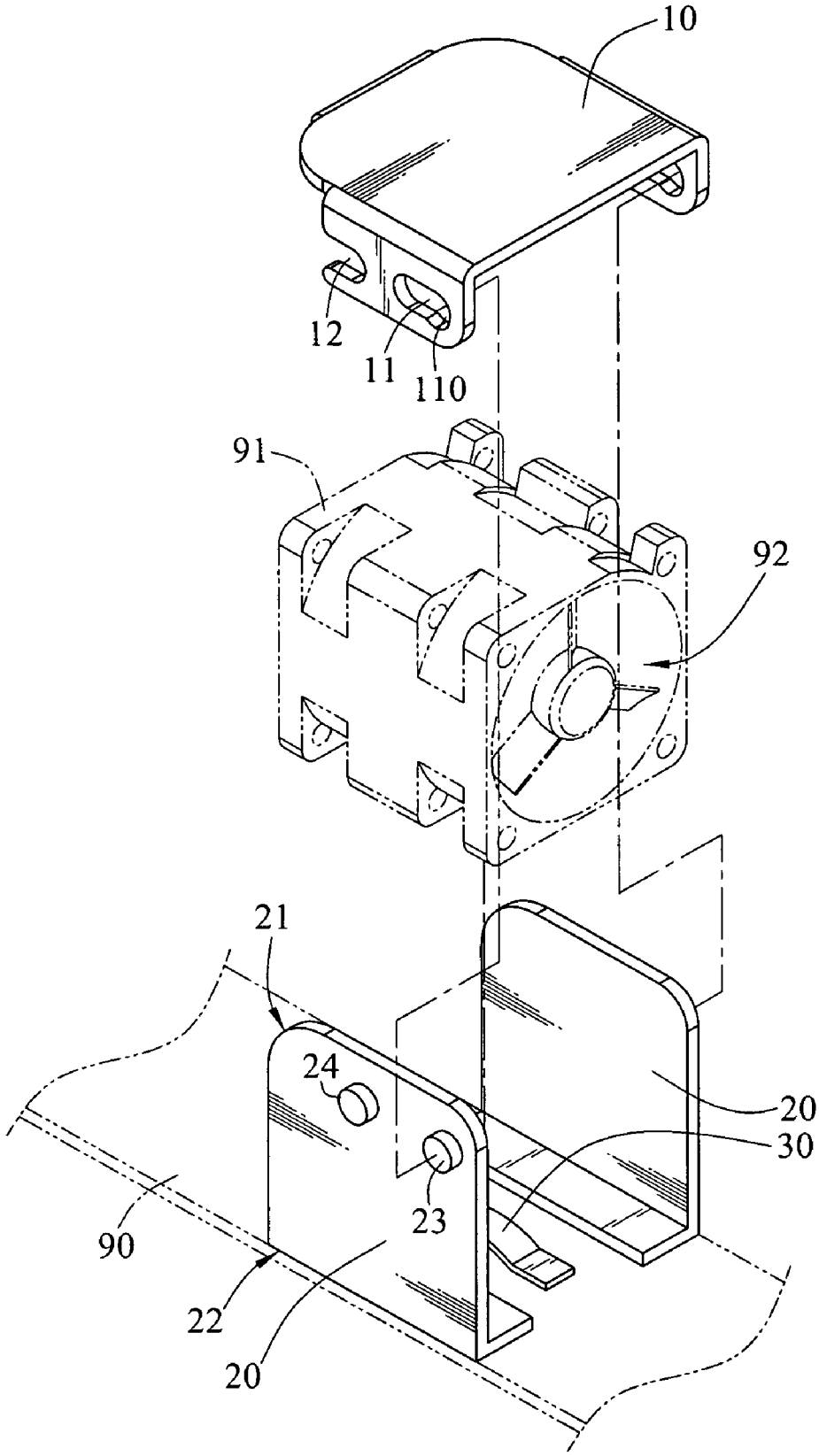
FIG. 1 is an exploded view of the present invention.
Figure 2:
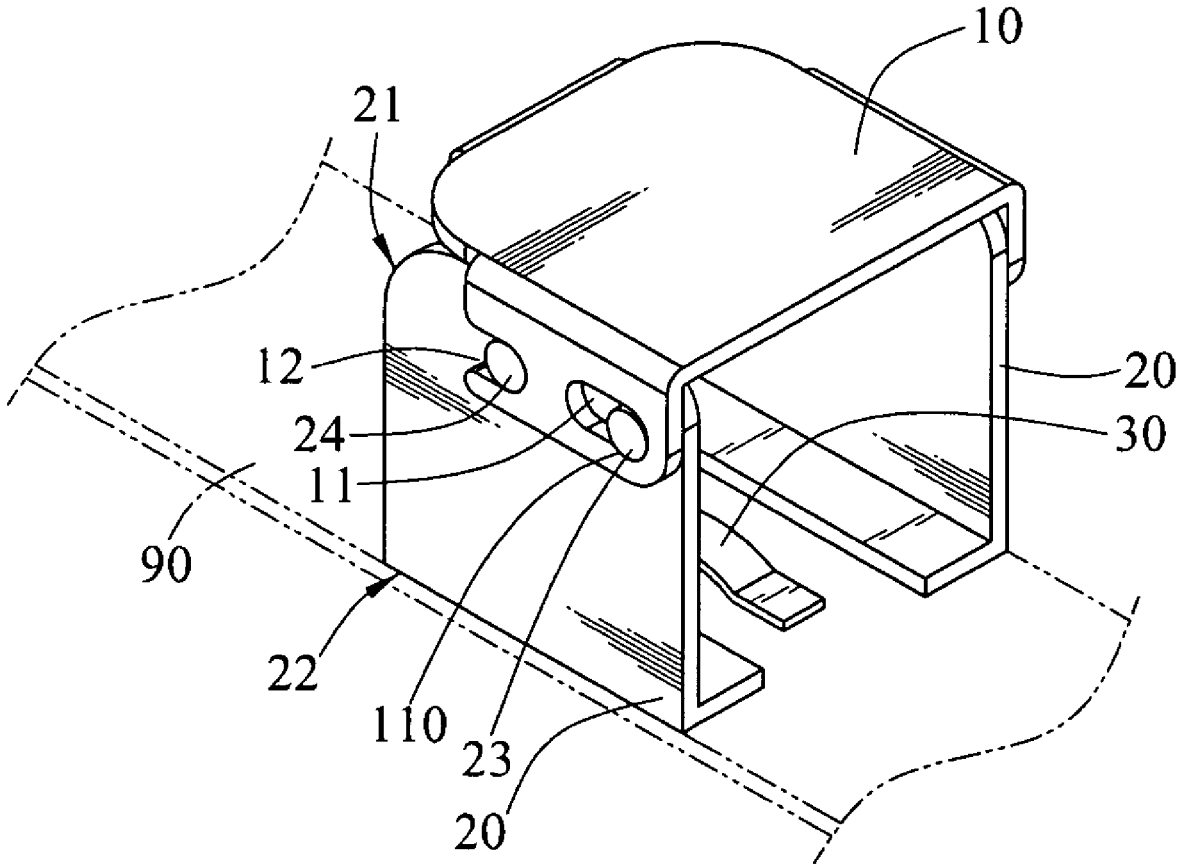
FIG. 2 is an assembled view of the present invention.

First, referring to FIGS. 1 and 2, an exploded stereogram and an assembled stereogram of the present invention are shown respectively. It can be seen from the figures that the fan fixing structure of the present invention includes a cover plate 10 and a guide piece 20. The guide piece 20 is secured on a housing 90 and is provided with a securing end 22 adjacent to the housing 90 and a guiding end 21 for guiding the fan 91 into the guide piece 20. The guide piece 20 is further provided with a rotating column 23 and a clipping column 24 at the guiding end 21. The guide piece 20 is disposed at a position different from an air inlet 92 and an air outlet (the position relative to the air inlet in the figure is not labeled since the opening thereof cannot be seen from the figure) of the fan 91, such that the air stream of the fan 91 is not blocked by the guide piece 20.

The cover plate 10 has a guide slot 11 and a clipping groove 12 respectively corresponding to the rotating column 23 and the clipping column 24. The cover plate 10 is pivoted on the rotating column 23 by the guide slot 11, and may pivotedly rotate between an open position and a closed position (which will be described in detail below). Besides, a resilient piece 30 is also disposed on the housing 90. Therefore, after the fan 91 is placed onto the bottom (near the securing position) of the guide piece 20, it presses against the resilient piece 30, such that the resilient piece 30 has a force which pushes the fan towards the guiding end 21.

Figure 3A:
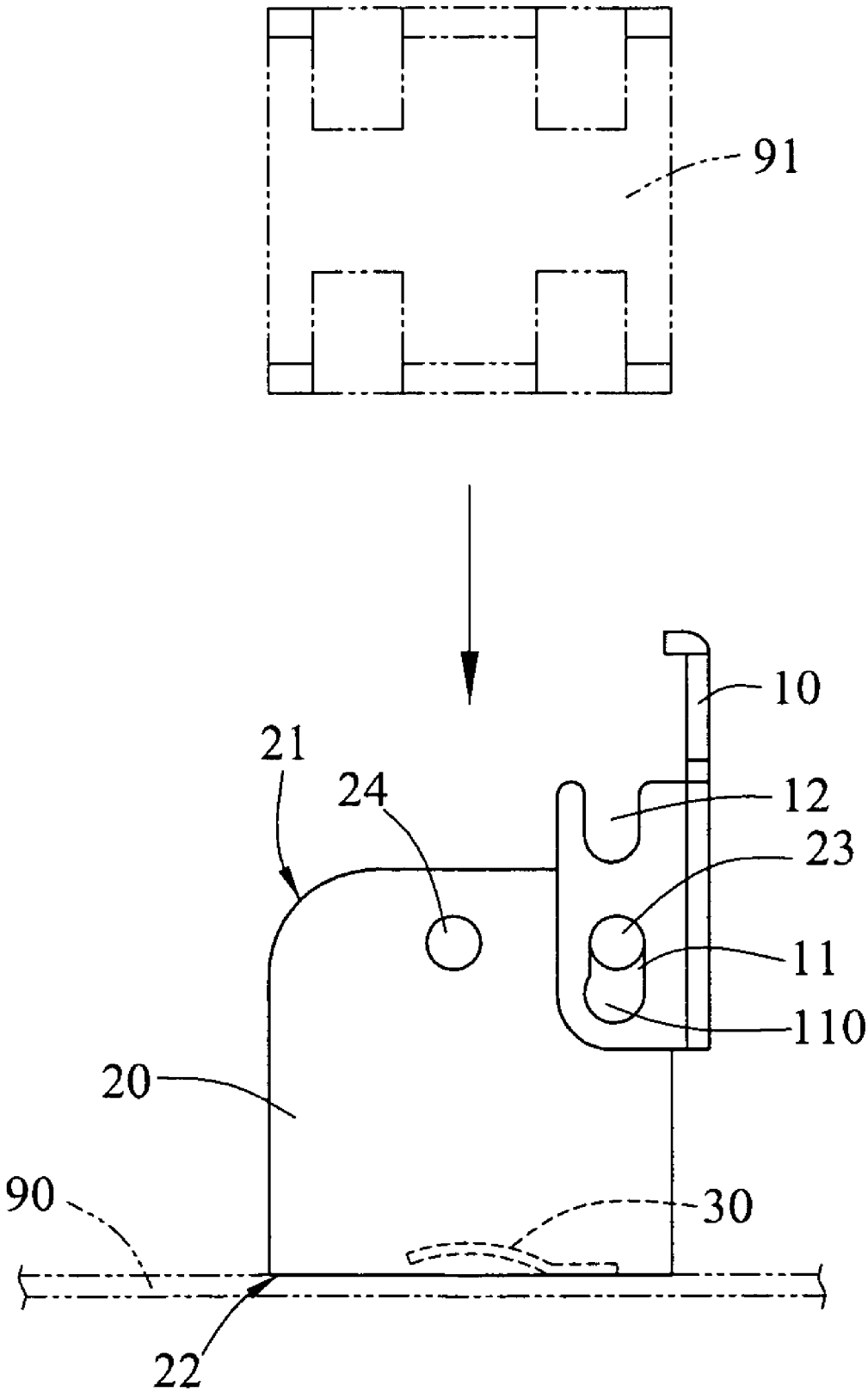
FIGS. 3A, 3B and 3C are schematic views of the operations of the cover plate and the guide piece of the present invention.
Figure 3B:
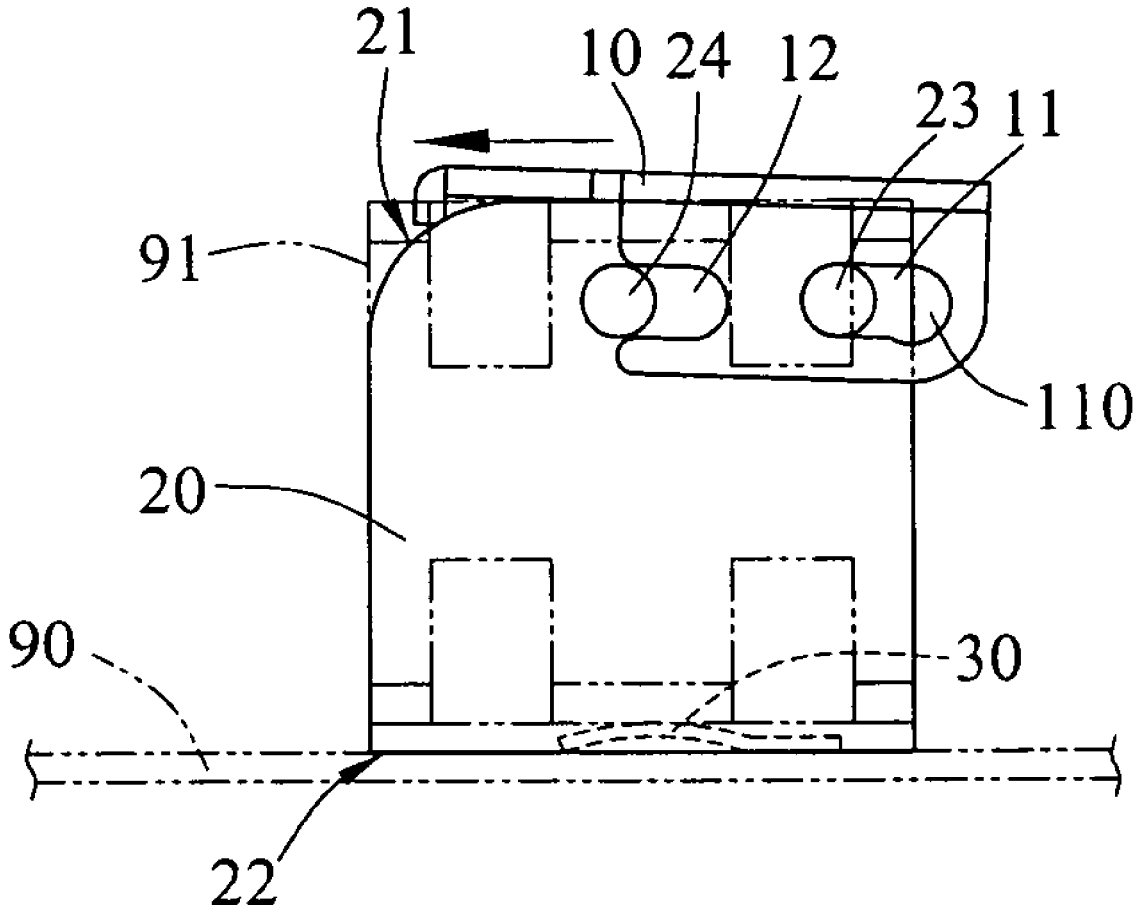
Figure 3C:
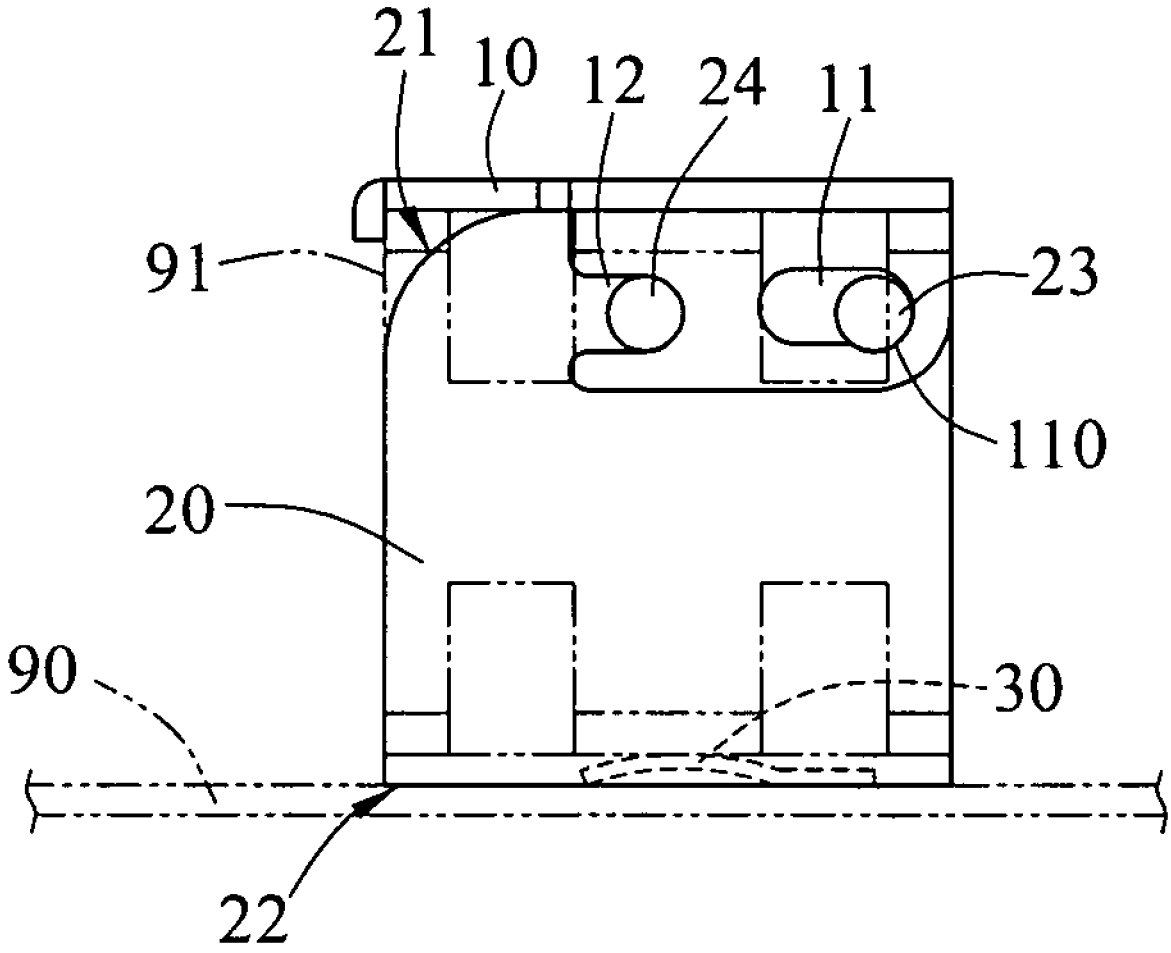

Next, referring to FIGS. 3A, 3B and 3C, schematic views of the operations of the cover plate 10 and the guide piece 20 of the present invention are shown. It can be seen from the figures that the cover plate 10 is pivoted on the rotating column 23 by the guide slot 11, and pivotedly rotates between an open position (as shown in FIG. 3A) and a closed position (as shown in FIG. 3B). When the cover plate 10 is located in the open position, the fan 91 can enter into the guide piece 20 by the guidance of the guide piece 20. Then, the cover plate 10 is pivotedly rotated to the closed position as shown in FIG. 3B. At this time, the fan 91 is pressed down and presses against the resilient piece 30, so that the resilient piece 30 in normal state has a force which pushes the fan 91 towards the guiding end 21. Finally, the cover plate is further moved towards the clipping column 24, so that the clipping groove 12 is engaged with the clipping column 24, which is referred to as an engaged position of the cover plate 10 (as shown in FIG. 3C). As a result, even if the resilient piece 30 pushes against the fan 91, the fan 91 will not be pushed out of the guide piece 20 and is maintained in the engaged position.

Furthermore, the clipping slot 11 is also provided with a positioning element 110. The positioning element 110 is a groove recessed inward from the clipping slot 11, and the recessing direction thereof is opposite to the direction of the resilient piece 30 pushing against the fan 91. Thus, when the cover plate 10 is located in the engaged position, the rotating column 23 is inserted in the positioning element 110, which positions the cover plate 10 in the engaged position, so that the cover plate 10 will not slide to the closed position or even pivotedly rotate to the open position. As such, it is ensured that the cover plate 10 secures the fan 91 in the guide piece 20.

When it is required to remove the fan 91, a user simply needs to move the cover plate 10 from the engaged position to the closed position (i.e., from FIG. 3C to FIG. 3B) and pivotedly rotate it to the open position (i.e., FIG. 3A). In this way, the fan 91 is disassembled easily without the need of any tool. It is understood that when moving the cover plate 10 from the engaged position to the closed position, it is necessary to overcome the positioning element 110 first before moving. In this way, a security measure is added.

Moreover, the aforementioned rotating column 23 and the clipping column 24 are corresponding to the guide slot 11 and the clipping groove 12. There may be a plurality of them in amount and they are disposed symmetrically, so that the forces pressing against the fan 91 are uniform. In addition, if the rotating column 23 and clipping column 24 are disposed at the cover plate 10, and the guide slot 11 and the clipping groove 12 are disposed at the guide piece 20, the same effect as the present invention is also achieved.

Also, the aforementioned positioning element 110 may also be disposed at the clipping groove 12 and the clipping column 24, and designed as the same recessed structure, thus achieving the same effect as the aforementioned positioning element 110. Or, any buckling structure in the engaged position of the cover plate 10 may achieve the same efficacy as the present invention. The applications of such technical means should belong to the equivalent applications of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fan fixing structure for holding and fixing a fan, comprising:

a housing;

at least a guide piece secured on the housing, the guide piece having a guiding end and a securing end, the guiding end guiding the fan to enter and move to the securing end, and the guide piece having at least a rotating column and a clipping column at the guiding end; and a cover plate, having at least a guide slot corresponding to the rotating column and at least a clipping groove corresponding to the clipping column, the cover plate being pivoted at the rotating column with the guide slot and pivotedly rotating between an open position and a closed position, when the cover plate in the closed position, the cover plate pressing the fan against the securing end and moving towards the clipping column by the guidance of the guide slot such that the clipping column is engaged in the clipping groove.

2. The fan fixing structure as claimed in claim 1, further comprising at least a resilient piece secured on the housing, and the resilient piece having a force for pushing the fan towards the guiding end when the fan is located in the securing end.

3. The fan fixing structure as claimed in claim 2, wherein the guide slot further comprises a positioning element, and when the clipping column is engaged in the clipping groove and is pushed by the force of the resilient piece, the positioning element positions the cover plate in a state where the clipping column is engaged with the clipping groove.

4. The fan fixing structure as claimed in claim 3, wherein the positioning element is a groove recessed inward from the guide slot, and the recessing direction of the groove is opposite to the direction of the pushing force of the resilient piece.

5. The fan fixing structure as claimed in claim 1, wherein the fan comprises an air inlet and an air outlet, and the guide piece is located in a position different from the air inlet and the air outlet.

* * * * *